US007828117B2

(12) United States Patent
Cole

(10) Patent No.: US 7,828,117 B2
(45) Date of Patent: Nov. 9, 2010

(54) FOLDABLE CHAIR AND LADDER COMBINATION

(76) Inventor: Kimberly J. Cole, 5281 Naples Cedar Dr., Wyoming, MI (US) 49519

( * ) Notice: Subject to any disclaimer, the term of this patent is extended or adjusted under 35 U.S.C. 154(b) by 1311 days.

(21) Appl. No.: 11/318,109

(22) Filed: Dec. 23, 2005

(65) Prior Publication Data

US 2007/0144831 A1 Jun. 28, 2007

(51) Int. Cl.
*A47C 13/00* (2006.01)

(52) U.S. Cl. ..... 182/33; 182/20; 182/21; 182/35; 182/165

(58) Field of Classification Search ..... 182/20, 182/21, 33, 35, 165
See application file for complete search history.

(56) References Cited

U.S. PATENT DOCUMENTS

| | | | | | |
|---|---|---|---|---|---|
| 190,027 | A | * | 4/1877 | Goffette | 182/33.2 |
| 241,548 | A | * | 5/1881 | Knight | 182/33.3 |
| 294,808 | A | * | 3/1884 | Reindel | 182/33.2 |
| 371,128 | A | * | 10/1887 | Dudley | 182/33.2 |
| 387,045 | A | * | 7/1888 | Braun | 182/33.2 |
| 677,052 | A | * | 6/1901 | Baumer | 182/33.2 |
| 791,509 | A | * | 6/1905 | Soergel | 182/165 |
| 1,362,051 | A | | 12/1920 | Stayman | |
| 1,439,437 | A | * | 12/1922 | New | 182/33 |
| 1,723,938 | A | * | 8/1929 | Ireland | 182/163 |
| 1,755,680 | A | | 4/1930 | Wuest | |
| 1,820,904 | A | * | 9/1931 | Beck | 182/29 |
| 1,822,399 | A | * | 9/1931 | Hayne | 182/33.6 |
| 1,827,418 | A | * | 10/1931 | Brown | 182/33 |
| 1,937,886 | A | * | 12/1933 | Grose | 182/33 |
| 1,950,591 | A | | 3/1934 | Bing | |
| 1,984,506 | A | * | 12/1934 | Walters | 297/123 |
| 2,024,960 | A | * | 12/1935 | Allerding | 182/29 |
| 2,052,450 | A | | 8/1936 | Cooney | |
| 2,207,923 | A | | 7/1940 | Kelso | |
| 2,678,084 | A | * | 5/1954 | Max | 297/120 |
| 2,805,703 | A | | 9/1957 | Wise | |
| 3,011,585 | A | | 12/1961 | Hamilton | |
| 3,058,544 | A | * | 10/1962 | Rossi et al. | 182/129 |
| 3,059,722 | A | * | 10/1962 | Rouse | 182/33 |
| 3,224,530 | A | | 12/1965 | King et al. | |
| 3,960,241 | A | | 6/1976 | Arias | |
| 4,130,316 | A | | 12/1978 | Rossi | |

(Continued)

FOREIGN PATENT DOCUMENTS

| | | |
|---|---|---|
| GB | 194139 | 3/1923 |

(Continued)

*Primary Examiner*—Jerry Redman
(74) *Attorney, Agent, or Firm*—Joseph G. Burgess; Burgess Law Office, PLLC

(57) ABSTRACT

A combination chair and ladder assembly including a center leg, a rear leg and a front leg wherein the rear leg is pivotally connected to the center leg and swings outwardly away from the center leg. The assembly includes a lower step or platform assembly including a first platform having first and second portions with a hinge connecting the first and second portions. The front leg is connected to the first platform. In addition, the chair and ladder assembly may include an upper step or platform assembly having a plurality of platforms pivotally connected to the center leg and to a front support member. The lower step or platform assembly operates independently of the upper step or platform assembly.

21 Claims, 6 Drawing Sheets

U.S. PATENT DOCUMENTS

| | | | | |
|---|---|---|---|---|
| 4,258,827 | A | 3/1981 | Klose | |
| 4,276,955 | A * | 7/1981 | Hickman | 182/33 |
| 4,557,350 | A * | 12/1985 | Wang | 182/33 |
| 5,722,507 | A * | 3/1998 | Kain | 182/129 |
| 7,487,859 | B2 * | 2/2009 | Wang | 182/21 |
| 2003/0015370 | A1 | 1/2003 | Aizenberg et al. | |
| 2007/0056797 | A1 * | 3/2007 | Wang | 182/21 |
| 2007/0144831 | A1 * | 6/2007 | Cole | 182/33 |

FOREIGN PATENT DOCUMENTS

| | | | |
|---|---|---|---|
| GB | 2043143 | A * | 10/1980 |
| GB | 2123888 | A * | 2/1984 |
| SI | 21445 | A | 10/2004 |

* cited by examiner

FOLDABLE CHAIR AND LADDER COMBINATION

CROSS-REFERENCE TO RELATED APPLICATIONS

Not Applicable

BACKGROUND OF THE INVENTION

1. Field of the Invention

The present invention relates to furniture and more particularly to a foldable chair and step ladder combination.

2. Description of Related Art

Over the years, attempts at combining chairs and ladders into a single piece of furniture have met with limited success. Many of the designs resulted in uncomfortable chairs, limited height ladders, stability concerns and/or cumbersome operability. Often the designs were overly complicated with limited use. For example, U.S. Pat. No. 1,950,591 to Bing discloses a chair ladder wherein the front portion of the seat rotates upward and around a front pivot point until it rests on the rear portion of the seat to form a ladder. In addition, U.S. Pat. No. 1,755,680 to Wuest illustrates another variation of a chair ladder wherein the rear legs act as both the back of the chair and as legs of the ladder. Similar to the chair disclosed above, the legs and seat portion of the chair pivot about a hinge located at the front of the seat portion to transform the device into either a chair or a ladder. While both patents illustrate a device capable of converting a chair into a ladder, neither device enables folding the entire assembly for storage. U.S. Pat. No. 1,362,051 to Stayman illustrates a stepladder chair that can be folded for storage. The device, however, is complicated and includes a plurality of pivotable links interconnecting the various legs and supports all of which must be folded in a precise complicated manner to transform the device between a ladder and a chair.

Accordingly, it is an object of the present invention to provide a chair ladder combination that is inexpensive to make, comfortable to use as a chair and to use as a ladder for climbing to heights above the normal height of a chair seat. It is another object of this invention to provide a foldable chair and ladder combination that folds into a relatively compact condition for easy transport and storage. It is a further object of this invention to provide a chair ladder combination comfortable to use as a chair without the need of specifically modifying the shape of the chair for sitting purposes.

SUMMARY OF THE INVENTION

The present invention is a combination chair and ladder assembly. The combination chair and ladder includes a center leg and a rear leg pivotally connected to the center leg. The rear leg swings outward away from the center leg to place the chair in an unfolded or open position. The chair and ladder assembly further includes a lower step or platform assembly including a first platform, including a first and second portion, with a hinge connecting the first and second portions. The first portion pivotally connected to the center leg and the second portion pivotally connected to the rear leg. In addition, a front leg is pivotally connected to the first portion of the platform whereby, both the front and rear legs along with the platform fold into or toward the center legs when the chair and ladder assembly is placed in the folded or closed position.

A further embodiment of the invention includes a second platform pivotally connected to the center leg and front leg, whereby the first and second platform are interconnected with the front leg and center leg in a manner forming a parallelogram linkage that maintains the positional relationship between the first platform or seat and second platform or step. Depending upon the desired use of the present invention, the first platform acts as either a seat or a step.

In an additional embodiment, the assembly includes an upper step or platform assembly having third and fourth platforms pivotally connected to the center leg and to a front support member. Once again, the various components of the upper step or platform assembly are connected in a manner forming a parallelogram linkage such that as the front support member swings or moves outward away from the center leg, the third and fourth platforms also move outward to form additional steps or shelf surfaces. The upper step assembly operates independent of the lower step assembly thereby enabling the apparatus to function as a chair when the upper step assembly is raised or located in line with the center leg and as a ladder when the upper step assembly is lowered such that the third and fourth platforms form additional steps or parallel surfaces.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
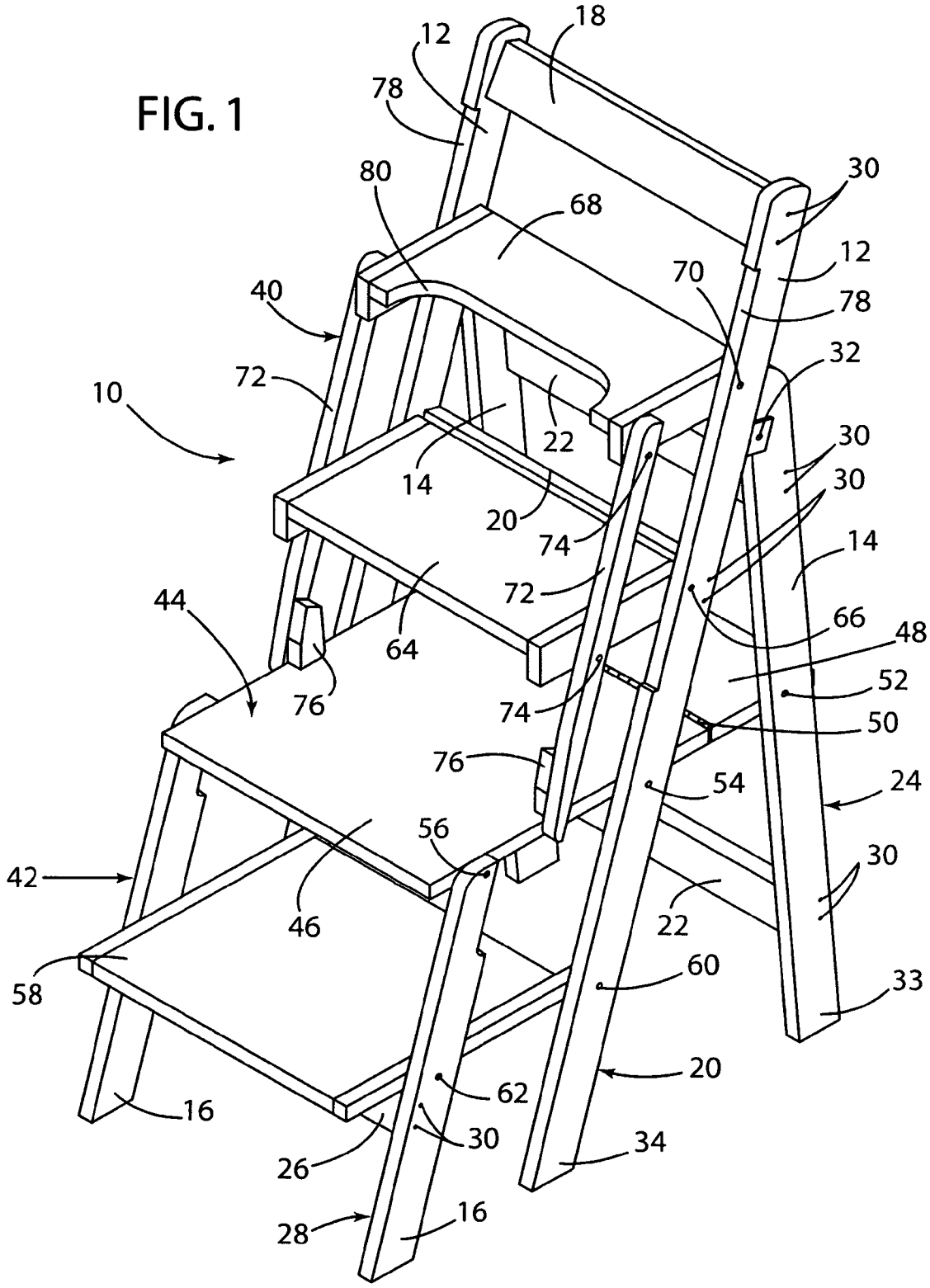
FIG. 1 is a perspective view of a combination chair and ladder according to the present invention.

Referring to the drawings, a combination chair and ladder assembly, seen generally at 10, according to the present invention is shown. As illustrated in FIG. 1 the chair and ladder assembly 10 includes center legs 12, rear legs 14 and front legs 16. Cross members 18 connect the center legs 12 to form a center leg assembly 20. Cross members 22 connect the rear legs 14 to form a rear leg assembly 24. In addition, a cross member 26 connects the front legs 16 to form a front leg assembly 28. As illustrated in the drawings, suitable fasteners 30 extend through the various leg members 12,14,16 to attach the leg members 12, 14, 16 to the cross members 18, 22, 26.

Figure 4:
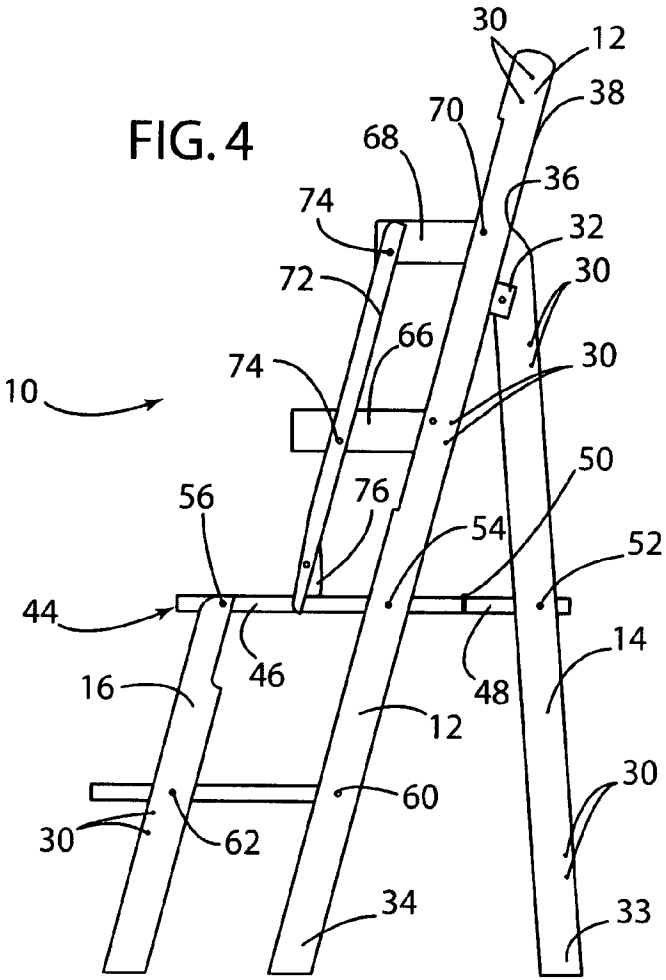
FIG. 4 is a side view of the combination chair and ladder of FIG. 1.

The rear leg assembly 24 is pivotally connected to the center leg assembly 20 using a bracket and pivot pin 32. Accordingly, the lower end 33 of the rear leg assembly 24 swings outward and away from the lower end 34 of the center leg assembly 20 forming an A-shape frame when the chair and ladder assembly 10 is placed in the unfolded, open position. Each of the rear legs 14 of the rear leg assembly 24 have a beveled or angled surface 36 (as shown in FIG. 4) extending an angle with respect to the longitudinal axis of the rear legs 14. It should be understood that the beveled or angled surface 36 engages the rear surface or back side 38 (as shown in FIG. 4) of the center legs 12 when the chair and ladder assembly 10 is placed in the open position. Accordingly, the degree of the angled surface 36 with respect to the longitudinal axis of the rear legs 14 along with the longitudinal length of the rear legs 14 defines the distance or amount of separation between the lower ends 33, 34 of the rear leg assembly 24 and center leg assembly 20.

Figure 7:
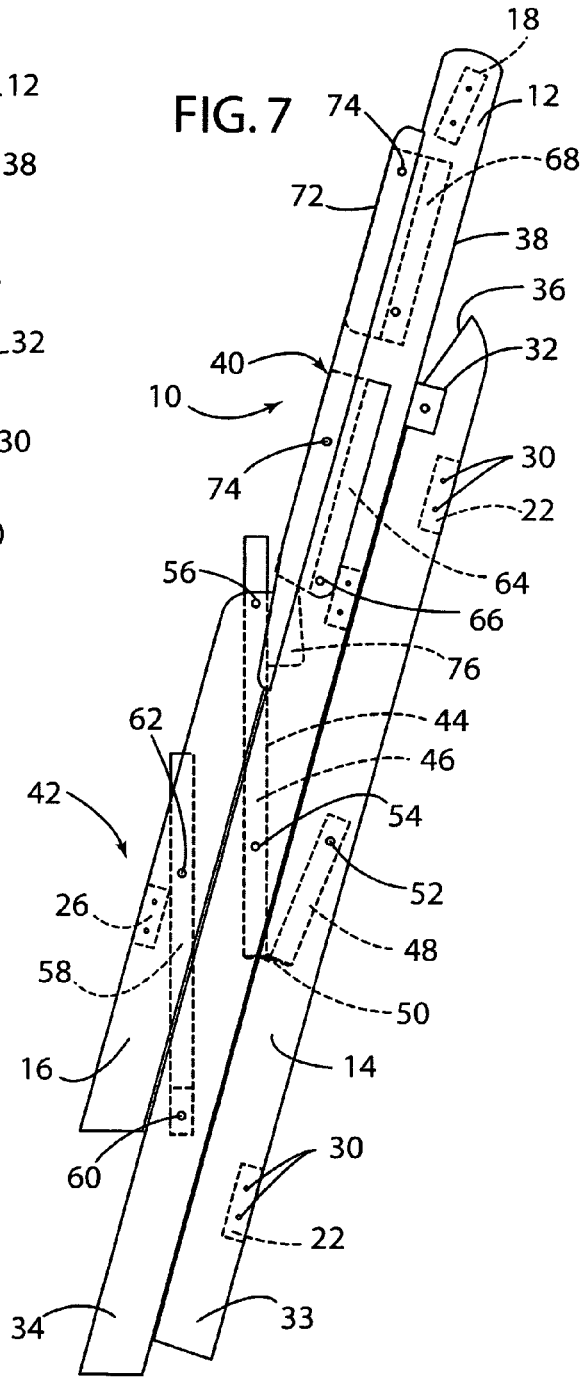
FIG. 7 is a side view of the combination chair and ladder similar to FIG. 6 illustrating the interior components in phantom.

As illustrated, the chair and ladder assembly 10 includes an upper step or platform assembly, seen generally at 40, and a lower step or platform assembly, seen generally at 42. The lower step or platform assembly 42 includes a first platform 44 having a first portion 46 and a second portion 48. A hinge 50 interconnects the first and second portions 46, 48. As illustrated, the second portion 48 is pivotally connected through pivot pin 52 to the rear leg 14 while the first portion 46 is pivotally connected through pivot pins 54, 56 to the respective center leg 12 and front leg 16. As illustrated in FIG. 7, the hinge 50 is secured with the hinge point located above the respective first and second portions 46, 48 such that the hinge 50, and correspondingly the first and second portions 46, 48 of the first platform 44, opens downward. That is, when the rear leg assembly 24 swings inward toward the center leg assembly 20 to position the chair assembly 10 in the folded, closed position, the hinge 50 moves downward toward the lower ends 33, 34 of the rear leg assembly 24 and center leg assembly 20 to a position below the pivot pins 52, 54.

Figure 2:
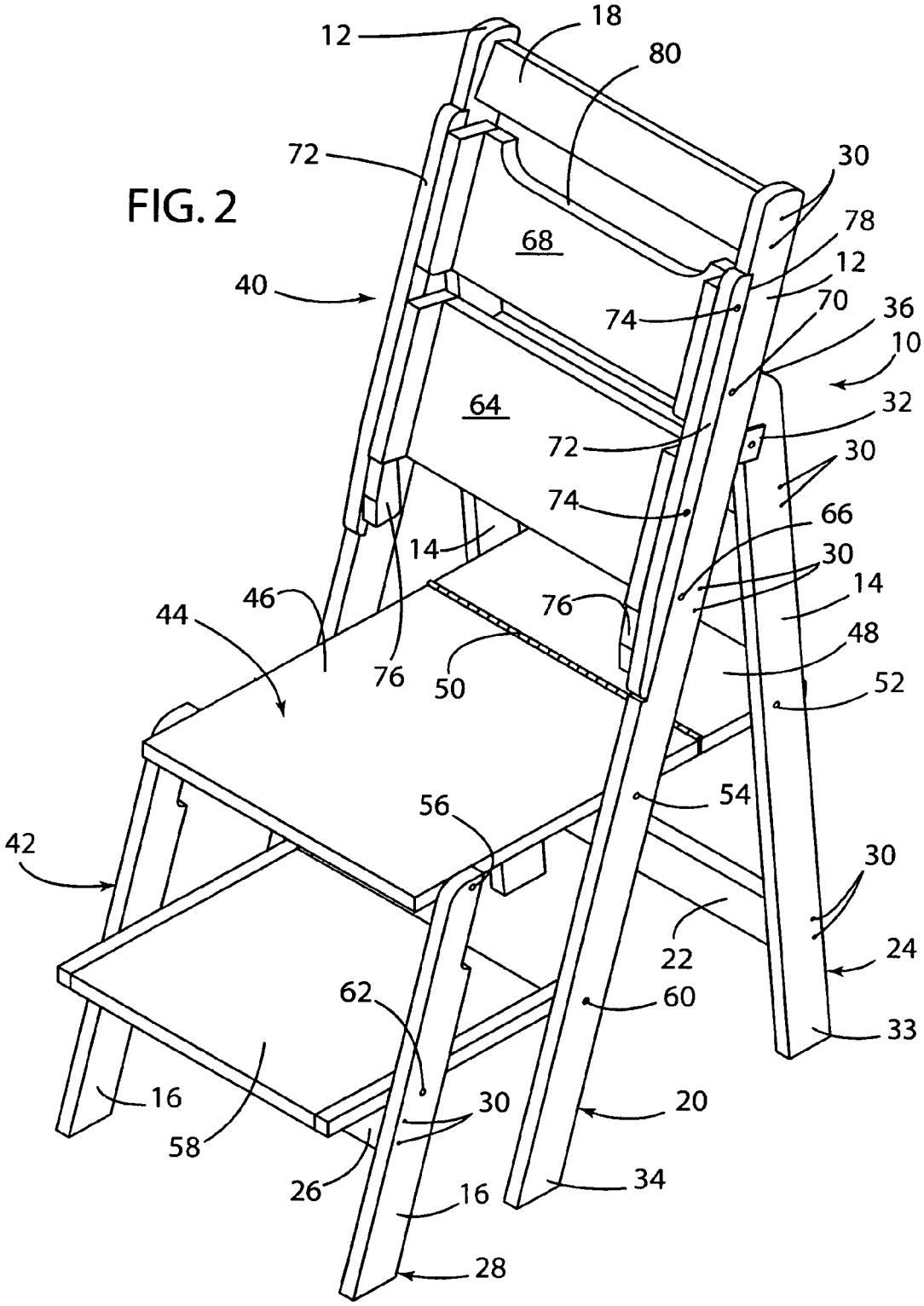
FIG. 2 is a perspective view of the combination chair and ladder of FIG. 1 illustrated with the upper step assembly folded and functioning as a backrest.

The lower step assembly 42 further includes a second platform 58 pivotally attached, via pivot pins 60, 62, to the center leg 12 and front leg 16. As illustrated in FIG. 2, the lower step assembly 42 is connected such that it forms a parallelogram linkage. Whereby the first platform 44 and second platform 48 remain parallel as the front leg assembly 28 moves outward and away from the center leg assembly 20 and the rear leg assembly 24 moves rearward away from the center leg assembly 20 placing the chair and ladder assembly 10 in the unfolded, open position. In this position, the first platform 44 forms a seat surface and the second platform 58 forms a footrest or step surface.

The upper step or platform assembly 40 includes a third platform 64 pivotally connected to the center leg 12 via pivot pin 66 and a fourth platform 68 pivotally connected to the center leg 12 via pivot pin 70. Front supports 72 are pivotally connected via pivot pins 74 to the third and fourth platforms 64, 68 to complete the upper step or platform assembly 40. Thus, the upper step or platform assembly 40 is connected such that it forms a parallelogram linkage whereby the third 64 and fourth 68 platforms remain parallel to one another. Stop members 76 located on the respective ends of the front supports 72 engages the first platform 44 and limit the travel of the respective third and fourth platforms 64, 68.

Figure 3:
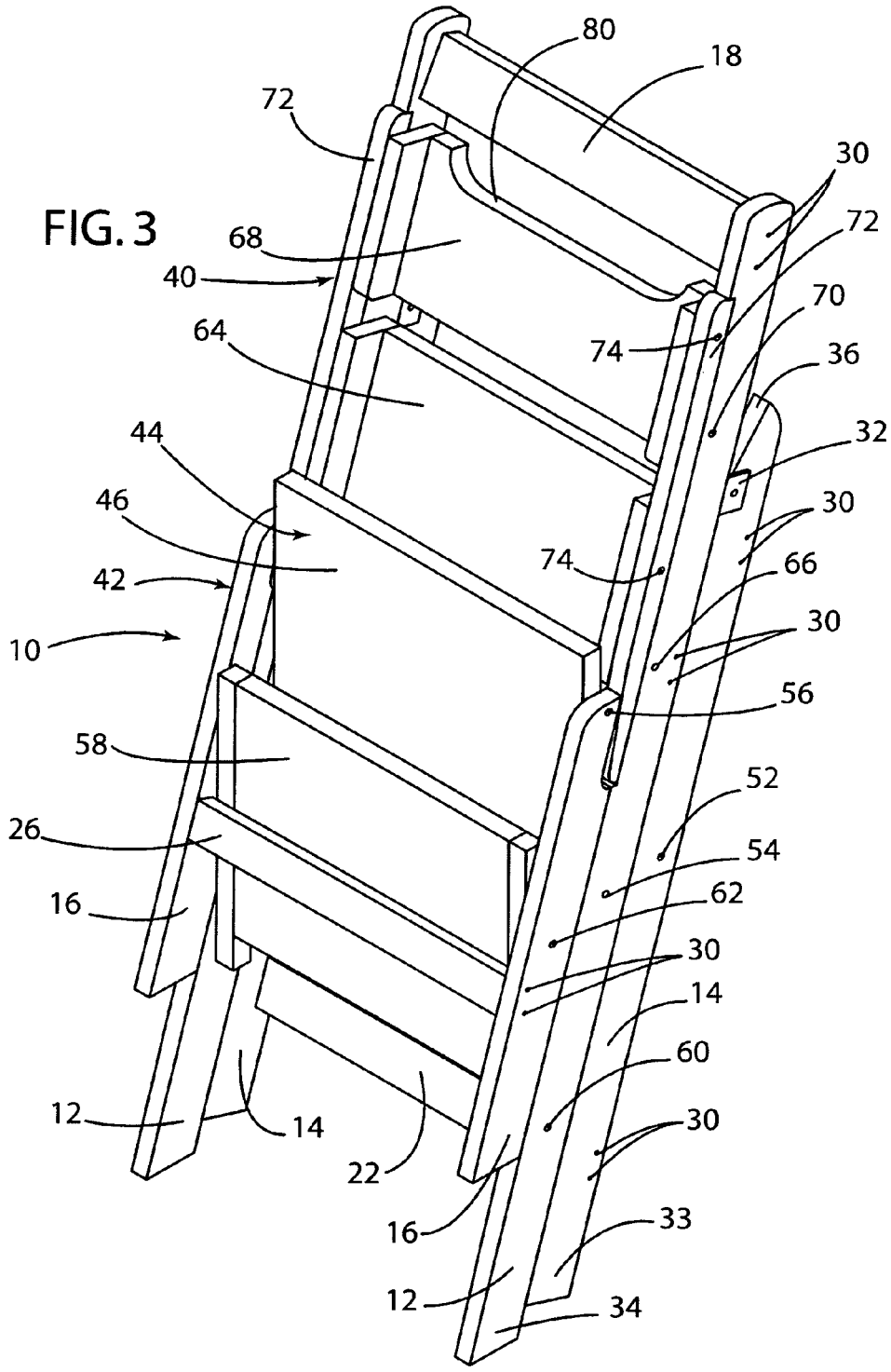
FIG. 3 is a perspective view of the combination chair and ladder of FIG. 1 illustrated in a folded position.
Figure 5:
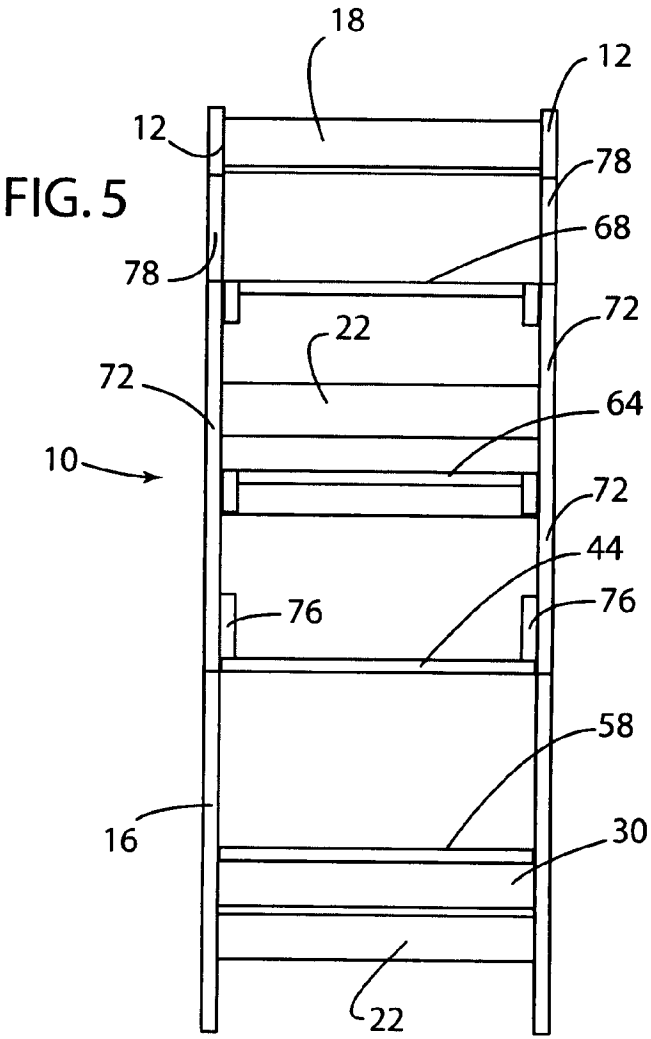
FIG. 5 is a front view of the combination chair and ladder of FIG. 1.
Figure 6:
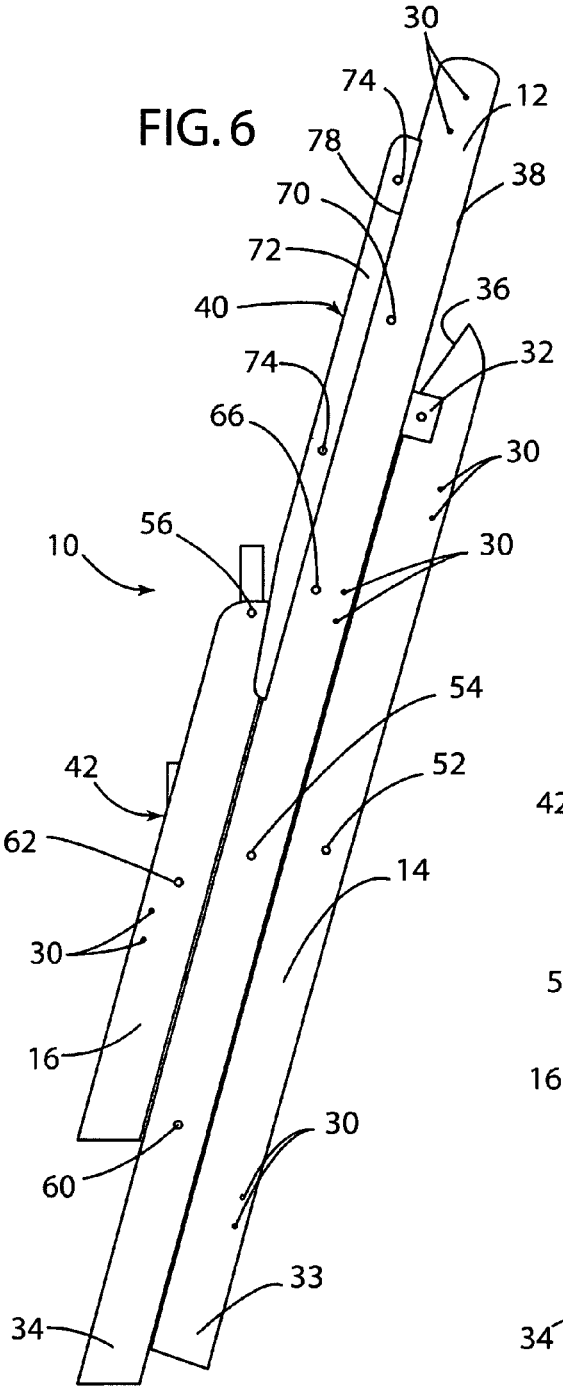
FIG. 6 is a side view of the combination chair and ladder of FIG. 1 illustrating the folded position.

As illustrated in FIGS. 3 & 6, when the upper step or platform assembly 40 is placed in the folded, closed position the front supports 72 are located in the recess or notched portions 78 of the center legs 12 and the third and fourth platforms 64, 68 are located in line with the center leg 12, see FIG. 7. When the upper step or platform assembly 40 is placed in the unfolded, open position the stop members 76 of the front supports 72 are seated on the first platform 44 such that the third and fourth platforms 64, 68 are located horizontally and form either a seating, step or shelf surface. In the disclosed embodiment, the fourth platform 68 of the upper step or platform assembly 40 includes a notched or cutout section 80 enabling the third platform 64 to be used as an additional seating surface. Typically, the fourth platform 68 provides a shelf and not a seat or step.

Figure 8:
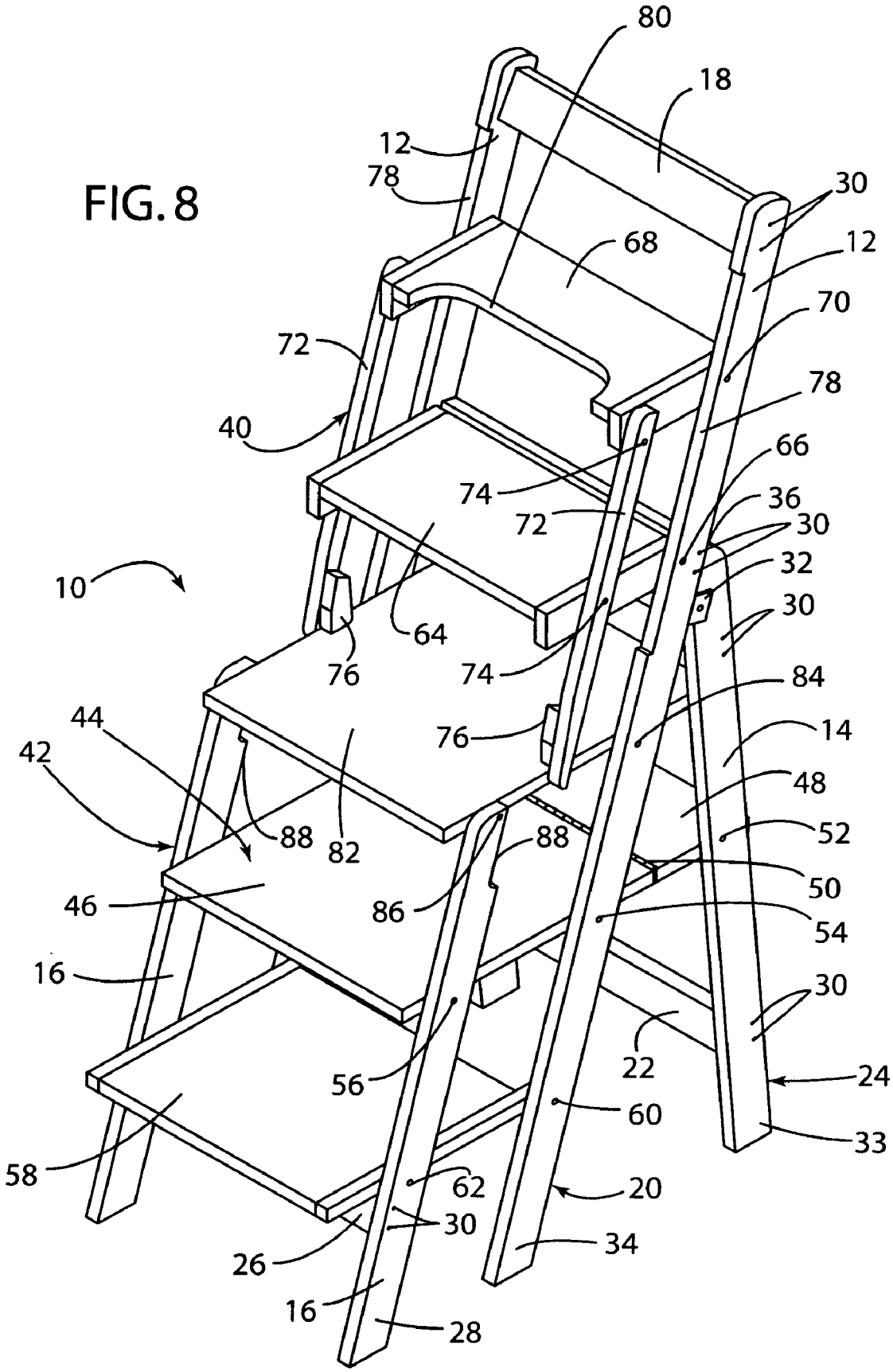
FIG. 8 is a perspective view of a combination chair and ladder according to a second or alternative embodiment of the present invention.

Turning now to FIG. 8, there is shown an alternative embodiment of the present invention wherein the lower step assembly 42 includes an additional platform, identified herein as a fifth platform 82. The fifth platform 82 is attached via pivot pin 84 to the center leg 12 and via pivot pin 86 to the front leg 16. As set forth above, fifth platform 82 is mounted in such that it forms a parallelogram linkage with the first and second platforms 44, 58 whereby they move in unison. As illustrated in FIG. 8, the front leg 16 includes a recess or notched section 88. The notched section 88 provides a space or relief area such that when the chair and ladder assembly 10 is placed in the folded, closed position a space exists for the front supports 72. It should be understood that while the present invention identifies the various platforms as first, second, etc. this is for illustration purposes only and the identification can be changed without departing from the scope of the present invention.

Accordingly, the present invention provides a chair and ladder assembly 10 that folds up in a compact position when not in use. Further, the upper and lower step or platform assemblies 40, 42 operate independent of one another, enabling the operator to use the chair and ladder assembly 10 in several different ways. In addition, the present design including the hinge 50 connecting the first and second portions 46, 48 of the first platform 44 enables easy folding of the chair and ladder assembly 10 wherein the rear leg assembly 24 and front leg assembly 28 each fold inward toward the center leg assembly 20.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A combination chair and ladder comprising:

a center leg;

a rear leg, said rear leg extending between a distal upper end and a lower end, said distal upper end of said rear leg is pivotally mounted to said center leg such that said rear leg pivots with respect to said center leg;

a first platform having a first portion and a second portion, a hinge connecting said first and second portions, said first portion pivotally connected to and pivoting with respect to said center leg and said second portion pivotally connected to and pivoting with respect to said rear leg; and a front leg pivotally connected to said first platform, said first platform pivoting with respect to said front leg.

2. A combination chair and ladder as set forth in claim 1 including a second platform attached to said front leg and said center leg.

3. A combination chair and ladder as set forth in claim 2 wherein said first and second platform connect to said front leg and said rear leg forming a parallelogram linkage.

4. A combination chair and ladder as set forth in claim 1 including a third platform pivotally attached to said center leg; and a front support pivotally attached to said third platform.

5. A combination chair and ladder as set forth in claim 4 including a fourth platform pivotally attached to said center leg and said front support.

6. A combination chair and ladder as set forth in claim 5 wherein said third platform and said fourth platform connect to said center leg and said front support forming a parallelogram linkage.

7. A combination chair and ladder as set forth in claim 6 including a stop attached to said front support, said stop engaging said first platform when said third platform is placed in an open position.

8. A combination chair and ladder as set forth in claim 4 wherein said center leg includes a recessed portion sized to receive at least a portion of said front support when said upper platform assembly is moved to a closed position.

9. A combination chair and ladder as set forth in claim 4 wherein said third and fourth platforms move independently of said first and second platforms.

10. A foldable combination chair and ladder comprising:

a center leg having a lower end;

a rear leg having a distal upper end and a lower end, said distal upper end pivotally attached to said center leg, said rear leg moving between a first, folded position wherein said lower end of said rear leg is positioned adjacent to said lower end of said center leg and a second, open position wherein said lower end of said rear leg is positioned spaced from said lower end of said center leg;

an upper step assembly operative to move between a first, open position and a second, closed position;

a lower step assembly operative to move between a first, open position and a second, closed position; and said upper and lower step assemblies operative to move independently of one another.

11. A foldable combination chair and ladder as set forth in claim 10 wherein said lower step assembly includes a platform, said platform having first and second portions, said second portion pivotally connected to said rear leg; and a front leg, said first portion of said platform pivotally connected to said front leg and said center leg.

12. A foldable combination chair and ladder as set forth in claim 11 wherein said lower step assembly includes a plurality of spaced platforms, said platforms pivotally connected to said front leg and said center leg and forming a parallelogram linkage.

13. A foldable combination chair and ladder as set forth in claim 12 wherein said upper step assembly includes a platform connected to said center leg; and a front support, said front support pivotally connected to said platform.

14. A foldable combination chair and ladder as set forth in claim 12 wherein said upper step assembly includes a plurality of platforms connected to said center leg; and a front support, said front support pivotally connected to said plurality of platforms and forming a parallelogram linkage.

15. A foldable combination chair and ladder as set forth in claim 14 wherein said upper step assembly includes a stop located on said front support, said stop operative to engage said lower step assembly when both said upper step assembly and said lower step assembly are placed in said open position.

16. A foldable combination chair and ladder as set forth in claim 14 wherein said center leg includes a recessed portion, said recessed portion receiving said front support when said upper step assembly is placed in said closed position.

17. A foldable combination chair and ladder as set forth in claim 11 wherein said upper step assembly includes a plurality of platforms pivotally connected to said center leg; and a front support, said front support pivotally connected to said plurality of platforms and forming a parallelogram linkage, said plurality of platforms connected to said front support and said center leg are in line with said center leg when said upper step assembly is placed in said closed position.

18. A foldable combination chair and ladder as set forth in claim 11 wherein said front leg and said rear leg are located next to said center leg when said lower step assembly is placed in said closed position.

19. A combination chair and ladder comprising:

a center leg;

a rear leg having a distal upper end and distal lower end wherein said distal upper end is; and pivotally attached to said center leg;

a first platform having a first portion and a second portion, said first portion and said second portion joined by a hinge, said first portion pivotally attached to said center leg and said second portion pivotally attached to said rear leg;

a front leg pivotally attached to said first portion of said first platform;

a second platform pivotally attached to said front leg and said center leg such that said front leg, said rear leg, said second portion of said first platform and said second platform form a parallelogram linkage;

third and fourth platforms pivotally connected to a front support and to said center leg such that said third platform, said fourth platform, said front support and said center leg form a parallelogram linkage whereby said third and fourth platforms are in line with said center leg when said front support is placed adjacent said center leg.

20. A combination chair and ladder as set forth in claim 19 including a stop located on said front support, said stop operative to engage said second portion of said first platform when said third and fourth platforms are located in a horizontal position.

21. A combination chair and ladder comprising:

a center leg;

a rear leg having a distal upper end and distal lower end wherein said distal upper end is pivotally attached to said center leg for movement between a first, folded position wherein a lower end of said rear leg is positioned adjacent to a lower end of said center leg and a second, open position wherein said lower end of said rear leg is positioned spaced from said lower end of said center leg;

a front leg;

a lower step assembly, said lower step assembly including a first platform connected to each of said center leg, rear leg and front leg and a second platform connected to each of said center leg and front leg, said lower step assembly operative to move between a lower step assembly open position wherein said front leg is positioned spaced from said center leg when said rear leg is placed in said second, open position and a lower step assembly closed position wherein said front leg is positioned adjacent said center leg, when said rear leg is placed in said first, folded position; and upper step assembly operative to move between an upper step assembly open position and an upper step assembly closed position independent of said lower step assembly when said rear leg is placed in said second, open position.

* * * * *

UNITED STATES PATENT AND TRADEMARK OFFICE

CERTIFICATE OF CORRECTION

PATENT NO. : 7,828,117 B2
APPLICATION NO. : 11/318109
DATED : November 9, 2010
INVENTOR(S) : Kimberly J. Cole It is certified that error appears in the above-identified patent and that said Letters Patent is hereby corrected as shown below:

In Column 6, Line number 14, Claim 19 kindly delete "; and".

In Column 6, Line number 15, Claim 19 after "leg;", kindly insert --and--.

Signed and Sealed this
First Day of March, 2011

David J. Kappos

David J. Kappos
*Director of the United States Patent and Trademark Office*